United States Patent [19]

Kamp

[11] Patent Number: 5,056,933

[45] Date of Patent: Oct. 15, 1991

[54] MULTIPOSITION INTERLOCKING CLOSURE FASTENING DEVICE

[75] Inventor: Ewald A. Kamp, Chicago, Ill.

[73] Assignee: First Brands Corporation, Danbury, Conn.

[21] Appl. No.: 387,907

[22] Filed: Sep. 22, 1989

Related U.S. Application Data

[63] Continuation of Ser. No. 122,589, Nov. 17, 1987, Pat. No. 4,854,017, which is a continuation of Ser. No. 887,912, Jul. 22, 1986, abandoned.

[51] Int. Cl.[5] ..... B65D 33/16

[52] U.S. Cl. ..... 383/63; 24/587; 493/214

[58] Field of Search ..... 383/63, 65; 493/214; 24/587

[56] References Cited

U.S. PATENT DOCUMENTS

| | | | |
|---|---|---|---|
| 4,665,557 | 5/1987 | Kamp | 383/63 |
| 4,710,968 | 12/1987 | Borchardt et al. | 383/63 |
| 4,778,282 | 10/1988 | Borchardt et al. | 383/63 |
| 4,854,017 | 8/1989 | Kamp | 383/63 |

*Primary Examiner*—Stephen P. Garbe

*Attorney, Agent, or Firm*—Gary L. Wamer

[57] ABSTRACT

An interlocking closure fastening device comprising a first closure element and a second closure element wherein the first closure element or the second closure element may comprise a plurality of closure element units having the same or alternately different structures. The closure fastening device is particularly adapted for multiposition occlusion of the closure elements such as in connecting various parts of plastic film to itself, different plastic films to each other, and variable-depth pouches, containers, or storage bags.

5 Claims, 7 Drawing Sheets

FIG. 3
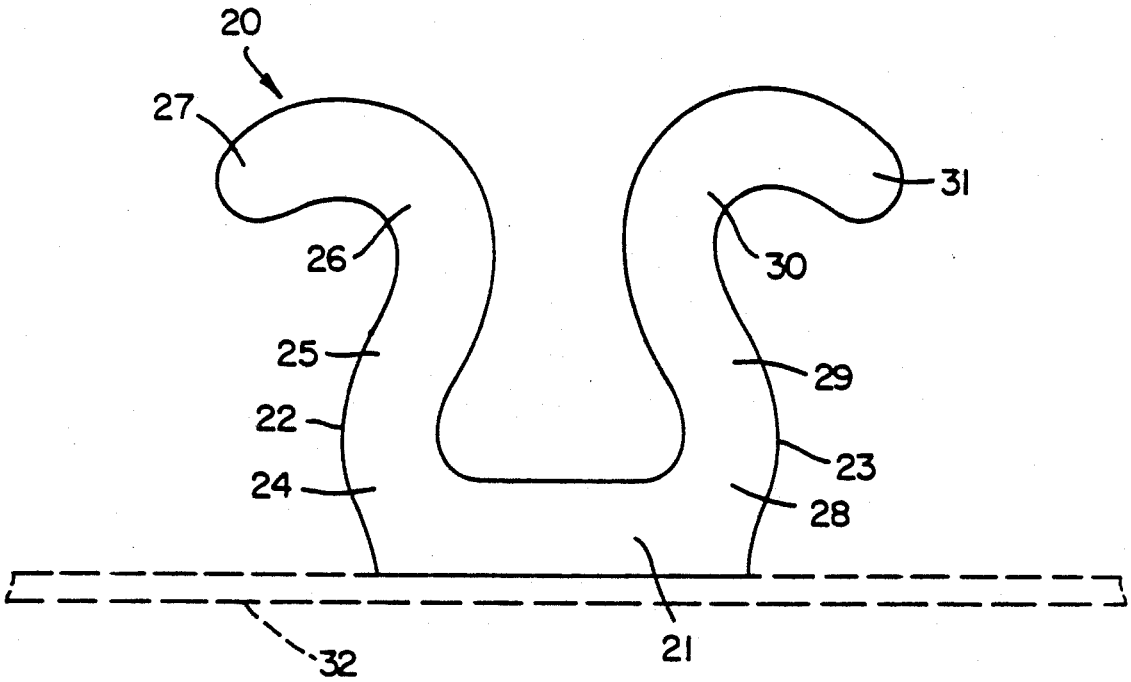
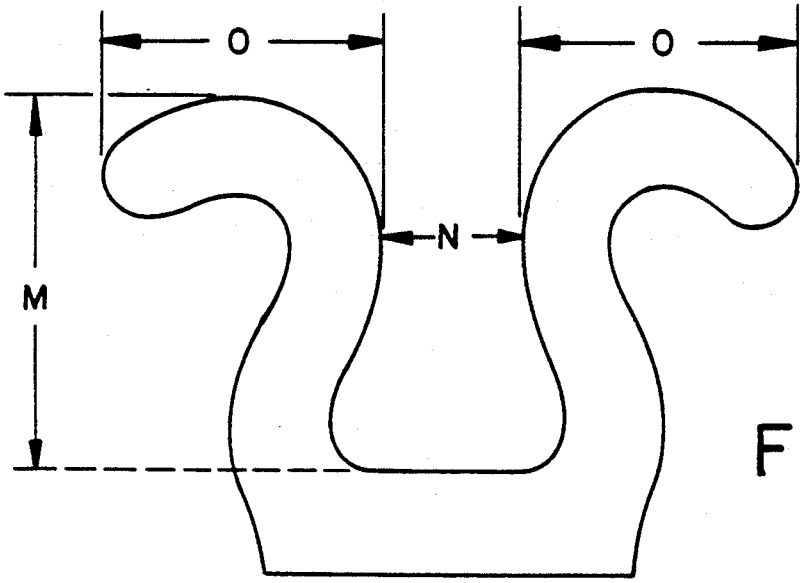
FIG. 4

MULTIPOSITION INTERLOCKING CLOSURE FASTENING DEVICE

This application is a continuation of U.S. application Ser. No. 122,589, filed Nov. 17, 1987, now U.S. Pat. No. 4,854,017, which is a continuation of application Ser. No. 887,912, filed Jul. 22, 1986, now abandoned.

FIELD OF THE INVENTION

This invention relates to an interlocking closure fastening device, and more particularly, to an interlocking closure fastening device comprising an omega-shaped closure element adapted to interdigitate with an arrowhead-shaped closure element wherein either closure element may be formed in multiples thereof and enable multiposition occlusion of the fastening device. The fastening device is particularly adapted for use in connecting various parts of plastic film to itself or different plastic films to each other.

BACKGROUND OF THE INVENTION

In general, closure fastening devices for use in connection with plastic bags, sheets, and the like are known. Furthermore, manufacturing methods for closure fastening devices made of plastic material are generally well known. Preferably, a closure fastening device should be suitable for economical manufacturing and should be relatively simple in design. In addition, the design should provide for variations in order to meet different needs. For example, it may be desirable to have a closure fastening device which enables occlusion of the closure elements at a variety of locations such as at random interdigitating positions. It is also desirable that, in operation, the closure fastening device be relatively easy to open or deocclude from the exterior of an occluded area, but be relatively difficult to deocclude from the interior of an occluded area so as to maintain the security of any contents therein.

When a closure fastening device is employed with a container, the container may be made from a thermoplastic material and the closure device and sidewalls of the container can be made integrally by extrusion as a unitary piece or can be made as separate components which are subsequently permanently connected together. The attachment of interlocking closure fastening devices to plastic sheeting is a well-known and established art involving either coextrusion of the closure elements and the films, or extrusion of either the closure elements or the film on the other after separate extrusion. Where both the closure elements and the film are extruded separately and stored for subsequent connection, they can then be joined by heat-seal or adhesive methods generally known to the artisan. Apparatus for such joining methods is also generally available.

A closure fastening device adapted to connect different parts of a plastic film to itself, or separate plastic films to each other, would permit the construction of a variety of new products, such as for example, a low cost VELCRO® type fastening device. That is, one of the closure elements may be constructed as to be present in more than one location spaced apart in parallel to permit size variations of assorted final products. For example, an interlocking closure fastening device enabling multiposition occlusion of the fastening device may be employed to provide useful products such as variable-depth pouches, storage or hanger garment bags, to clip together sheeting, and to make large covers from a number of smaller sheets.

SUMMARY OF THE INVENTION

The foregoing objectives, and other, may be attained by providing an interlocking closure fastening device wherein the fastening device comprises a first closure element having a generally omega-shaped profile portion comprising a generally straight bottom portion attached to a base and having two spaced apart arm portions extending outwardly from opposite ends of said bottom portion, said arm portions being curved inwardly towards each other in the section closest to said bottom portion and thereafter curving outwardly and terminating in outwardly facing curvilinear hook portions. By omega shape is meant having a shape like the last letter of the Greek alphabet. The second closure element comprises a profile portion having a generally straight bottom portion attached to a base and having at least one straight or rod-shaped portion extending from said bottom portion in a generally perpendicular direction and having a generally rounded extremity with a portion of enlarge width located anteriorly of said extremity. The first closure element and the second closure element form an interlocked closure fastening device when they are pressed and occluded together.

The afore-described closure elements are adapted to occlude in the following manner. The bottom portion of the second closure element is flexed to widen the space between adjoining rod-shaped projections and at least one arm of the omega-shaped profile of the first closure element is inserted between two adjoining projections. When the flexing is released said arm is trapped between the two adjoining projections. De-occlusion is achieved by reversing the process. Occlusion may also be accomplished by forcing the two closure elements together by manual pressure causing bending type deflections to take place and achieve the same result as by the above method.

In another embodiment of this invention, the interlocking closure fastening device comprises a first closure element comprising a profile having a generally straight bottom portion attached to a base and having a straight or rod-shaped portion extending in a generally perpendicular direction from said bottom portion and having a generally rounded extremity with a portion of enlarged width located anteriorly of said extremity. The closure device includes a second closure element comprising a plurality of generally omega-shaped profile portions each of which comprises a generally straight bottom portion attached to a common base and having two spaced apart arm portions extending outwardly from opposite ends of said bottom portion, said arm portions being curved inwardly towards each other in the section closest to said bottom portion and thereafter curving outwardly and terminating in outwardly facing curvilinear hook portions. The first closure element and the second closure element form an interlocked closure fastening device when they are pressed and occluded together.

The afore-described first closure element and the second closure element are adapted to engage and disengage each other by means of a flexing action whereby the arm portions of the profile portion of the second closure element are caused to flex outwardly to form a straddle type of occlusion with the straight or rod-like portion of the profile of the first closure element, as more fully described hereinafter.

In a further embodiment of this invention, the interlocking closure fastening device comprises a first closure element having a generally omega-shaped profile portion as defined above. The closure device includes a second closure element comprising a profile having a generally straight bottom portion attached to a base and having a plurality of straight or rod-shaped portions extending in a generally perpendicular direction from said bottom portion and having a generally rounded extremity with a portion of enlarged width located anteriorly of said extremity. Each of the straight or rod-shaped portions is flanked on either side by a generally Y-shaped profile having the stem portion extending in a generally perpendicular direction from said bottom portion and having an overall length which is shorter than that of said straight or rod-shaped portions. The straight or rod-shaped portions of the profile of the second closure element act as occlusion guides and the Y-shaped profile portions act as locking post units as will be described more fully hereafter. The first closure element and the second closure element form an interlocked closure fastening device when they are pressed and occluded together.

BRIEF DESCRIPTION OF THE DRAWINGS

FIG. 3 is a cross-sectional view of one embodiment of the first closure element of the closure fastening device of this invention.

FIG. 4 is a cross-sectional view of the first closure element shown in FIG. 3 to illustrate typical physical dimensions thereof.

DETAILED DESCRIPTION OF THE PREFERRED EMBODIMENTS

For a fuller understanding of the nature of the invention, reference should be made to the following detailed description, taken in conjunction with the accompanying drawings.

Figure 1:
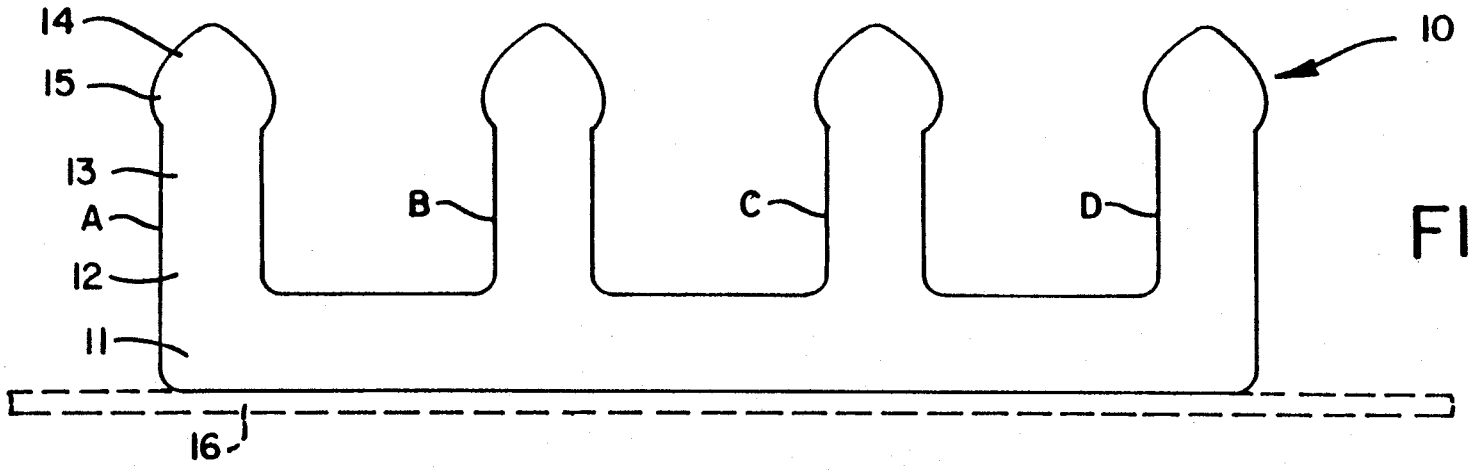
FIG. 1 is a cross-sectional view of one embodiment of the second closure element of the closure fastening device of this invention.

FIG. 1 is a cross-sectional view of one embodiment of one of the closure elements of a closure fastening device in accordance with this invention. As shown in FIG. 1, closure element 10 comprises a plurality of straight or rod-shaped profiles generally designated A, B, C, and D. Each of the closure element units have the same structure and have a general arrowhead shape by which is meant a straight shaft or rod-shaped portion terminating in an enlarged head. Because these structures are the same, the structure need be described only with respect to one of them, for example, profile element unit A. The latter comprises a bottom portion 11 which may have a generally straight line, and which forms the common bottom portion for each of B, C and D also. Extending from bottom portion 11 in a generally perpendicular direction therefrom is a straight or rod-shaped portion 12 which terminates as a generally-rounded, arrowhead-shaped extremity 14. Extremity 14 has at least one enlarged portion 15 located anterior of the extremity. Elements A, B, C, and D are generally parallel to each other, and generally equally space from each other. Optionally, but preferably closure element 10 is also provided with base portion 16 shown in dotted lines for attachment of closure element 10 to the sidewall of a bag or container, or to a plastic sheet.

Figure 2:
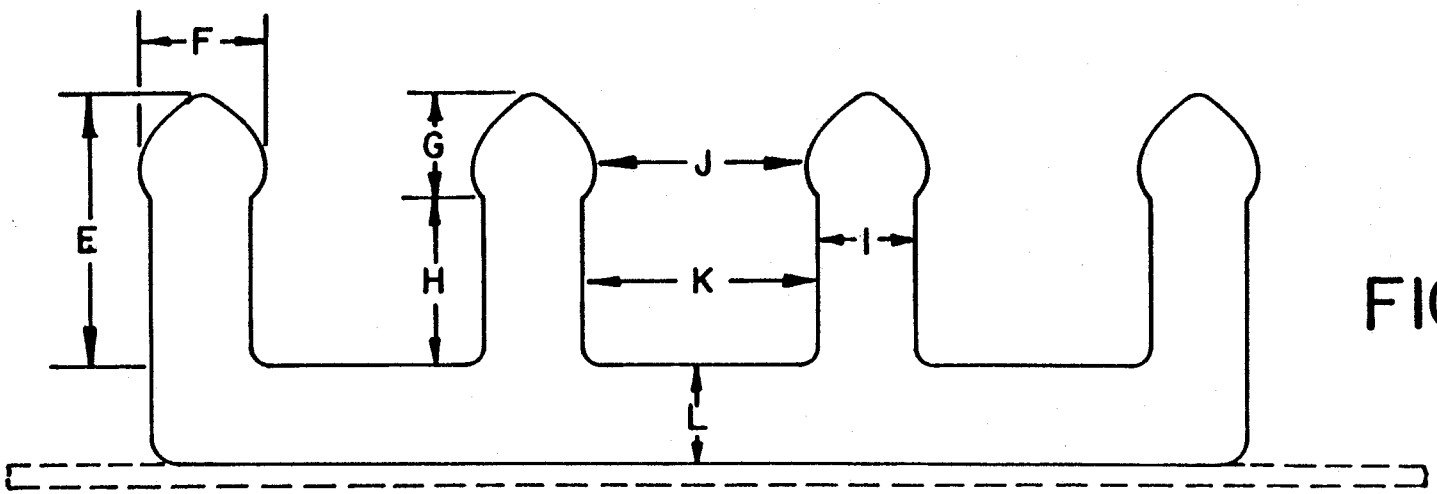
FIG. 2 is a cross-sectional view of the second closure element shown in FIG. 1 to illustrate typical physical dimensions thereof.

FIG. 2 is a cross-sectional view of the second closure element shown in FIG. 1 to illustrate certain relative dimensions thereof for comparison with relative dimensions of the other closure element (shown in FIG. 3) of the closure device under discussion.

As shown in FIG. 2, E represents the length dimension of closure element unit A of closure element 10 as measured from the interior surface of the bottom portion 11 to its extremity 14.

F represents the width dimension of enlarged portion 15.

F represents the length dimension of enlarged portion 15 to extremity 14.

H represents the length dimension from the interior surface of bottom portion 11 to the interior surface of enlarged portion 15.

I represents the width dimension of arm portion 13.

J represents the distance between the enlarge portions 15 of closure element units A, B, C, and D.

K represents the distance between the arm portions 13 of closure element units A, B, C, and D.

L represents the height of bottom portion 11.

FIG. 3 is a cross-sectional view of the closure element which cooperates with the closure element of FIG. 1 to form a closure fastening device in accordance with this invention. As shown in FIG. 3, first closure element 20 has a generally omega-shaped profile, and comprises a bottom portion 21 which may have a generally straight line configuration. Extending from bottom portion 21 in a generally perpendicular direction therefrom is a first arm portion 22 and a second arm portion 23. As shown in FIG. 3, first arm portion 22 and second arm portion 23 are spaced apart from each other. First arm portion 22 of closure element 20 has a lower portion 24 which initially curves generally outwardly, a middle portion 25 which curves generally inwardly, and a top portion 26 which curves generally outwardly before terminating in an outwardly, laterally extending, curvilinear hook portion 27.

Second arm portion 23 of closure element 20 has a lower portion 28 which initially curves generally outwardly, a middle portion 29 which curves generally inwardly, and a top portion 30 which curves generally outwardly before terminating in an outwardly, laterally extending, curvilinear hook portion 31. Optionally, but preferably, closure element 20 is also provided with base portion 32 shown in dotted lines for attachment of closure element 20 to the sidewall of a bag or container, or to a plastic sheet.

FIG. 4 is a cross-sectional view of the first closure element shown in FIG. 3 to illustrate typical relative dimensions thereof for comparison with the relative dimensions of the other closure element shown in FIGS. 1 and 2.

As will be appreciated by one skilled in the art the actual dimensions of the various fasteners of the closure elements in question are a matter of designer choice but certain relative dimensions are of importance.

As shown in FIG. 4, m represents the maximum height dimension of the closure element 20 of FIG. 3 measured from the interior of base portion 21 to the uppermost top surface of arms 27 and 31. N represents the minimum width separating the interior surfaces of the middle portions 25 and 29 of the arms of said closure element 20. O represents the lateral dimension of the hook portions 27 and 31 of the tops 26 and 30 of the arms of said closure element 20.

In comparing the relative dimensions shown in FIGS. 2 and 4 it will be appreciated that the overall length E of unit a of closure element 10 approximates the height dimension M of closure element 20. Further, the width F of the enlarged portion of unit A preferably slightly exceeds the minimum width N between the interior surfaces of the arms of closure element 20 and the width I of the main shaft of unit A approximates said minimum width N. The dimension O of the hook portions 27 and 31 of closure element 20 exceeds the dimension J of closure element 10 and approximates and preferably slightly exceeds that of dimension K of said closure element 10.

Figure 5:
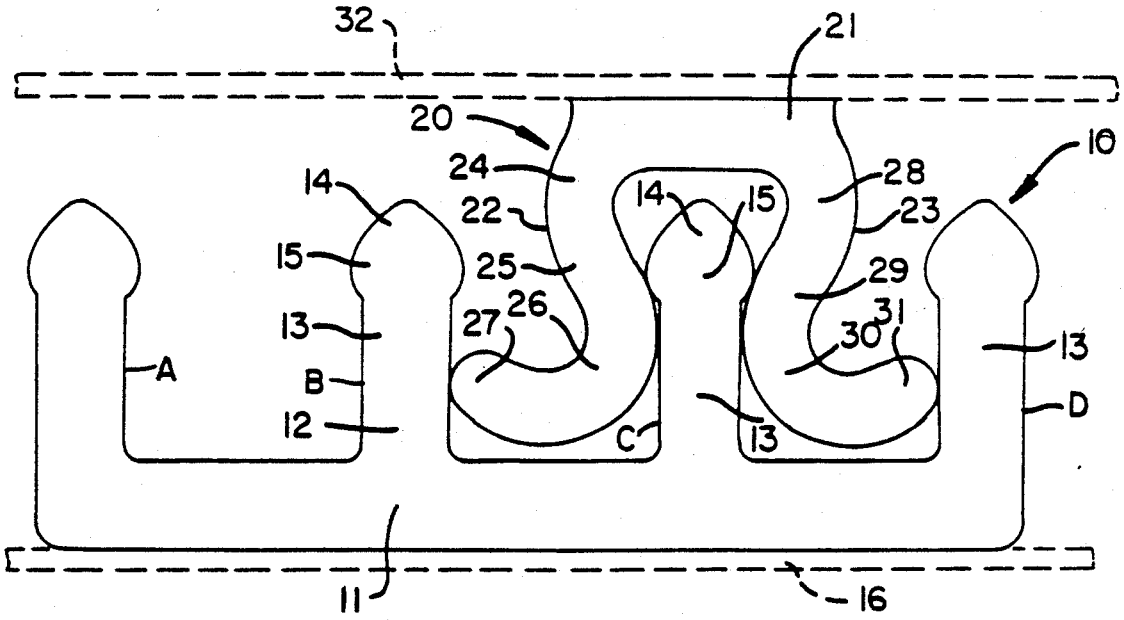
FIG. 5 is a cross-sectional view of the second closure element shown in FIG. 1 and the first closure element shown in FIG. 3 in an occluded position.

FIG. 5 is a cross-sectional view of the closure element 10 shown in FIG. 1 and the closure element 20 shown in FIG. 3 in an occluded position. As shown in FIG. 5, first arm portion 22 and second arm portion 23 of first closure element 20 may straddle over closure element unit C of second closure element 10 during occlusion of the fastening device. When so occluded, top portion 26 and top portion 30 of first closure element 20 are in contact with arm portion 13 and enlarged portion 15 of extremity 14 of closure element unit C. In addition, hook portion 27 of first closure element 20 is in contact with arm portion 13 of closure element unit B of second closure element 10, and hook portion 31 of first closure element 20 is in contact with arm portion 13 of closure element unit D of second closure element 10.

Figure 6:
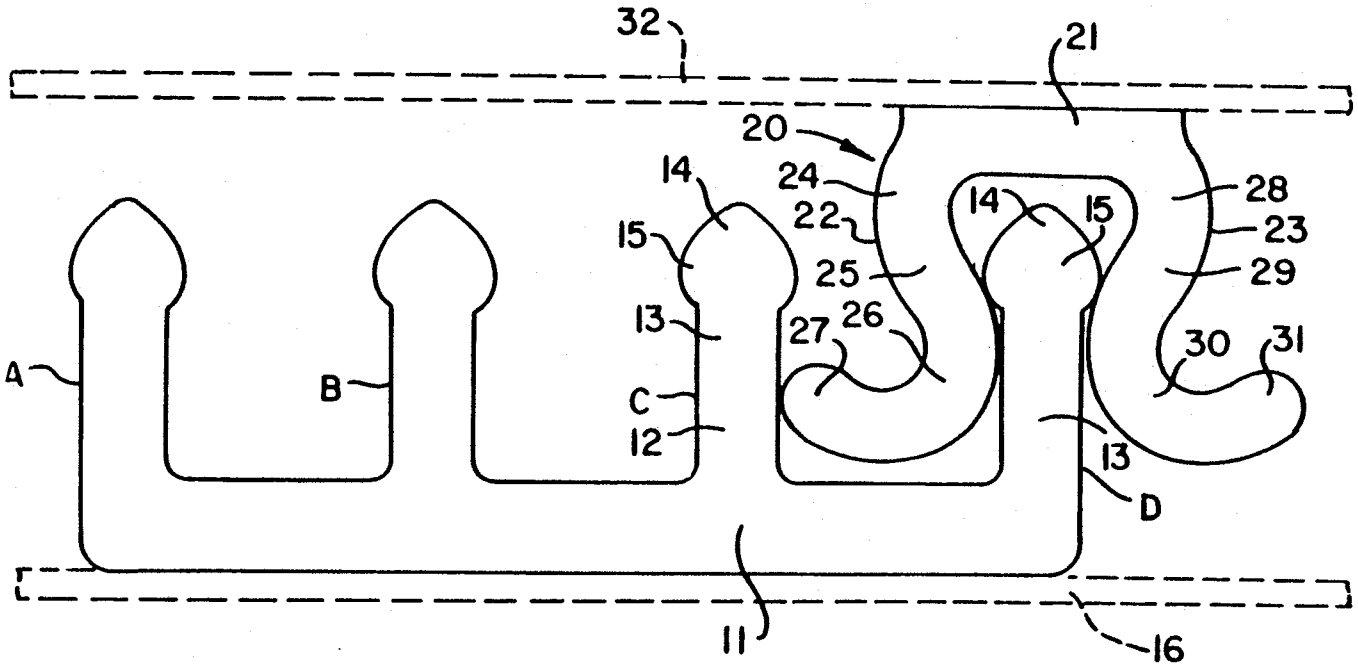
FIG. 6 is a cross-sectional view of the second closure element and the first closure element shown in FIG. 5 in a different occluded position.

FIG. 6 is a cross-sectional view of the closure element 10 and the closure element 20 shown in FIG. 5 in a different occluded position. As shown in FIG. 6, first arm portion 22 and second arm portion 23 of first closure element 20 may straddle over unit D of closure element 10 during occlusion of the fastening device. When so occluded, top portion 26 and top portion 30 of closure element 20 are in contact with arm portion 13 and enlarged portion 15 of extremity 14 of closure element unit D. In addition, hook portion 27 of closure element 20 is in contact with arm portion 13 of unit C of closure element 10. It can be seen from FIG. 5 and FIG. 6 that there are at least four possible occlusion positions for the fastening device. In addition, closure element 10 may have more than the four units A, B, C, and D described, i.e., as many closure element units as desired to provide still more available possible occlusion positions with first closure element 20.

Figure 7:
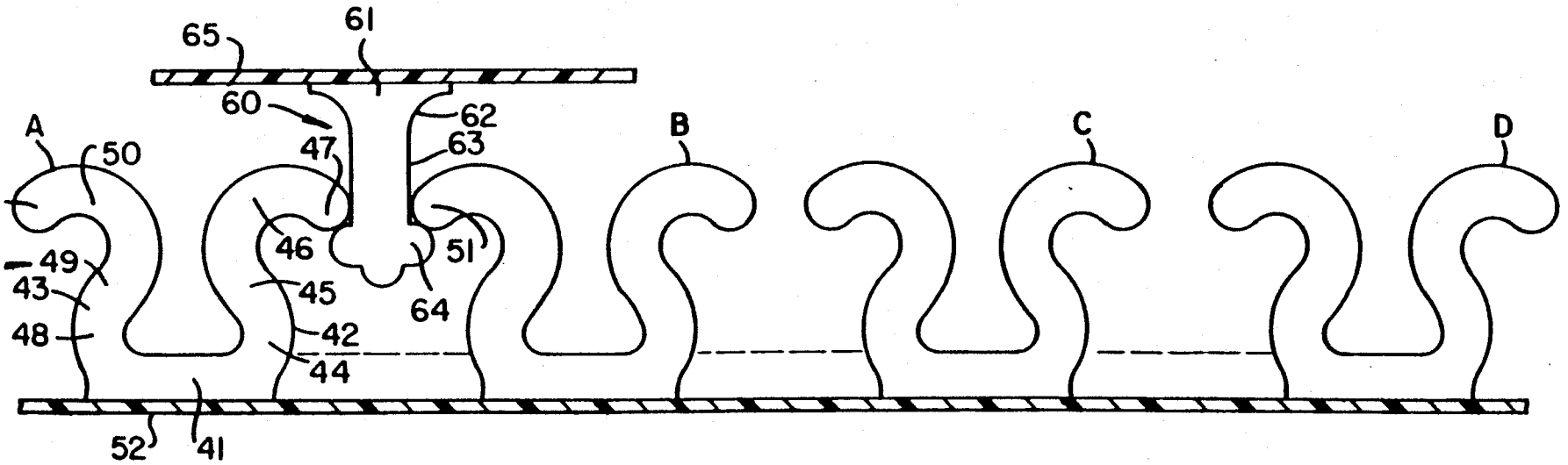
FIG. 7 is a cross-sectional view of another embodiment of the closure fastening device of this invention.

FIG. 7 is a cross-sectional view of another embodiment of the closure fastening device of this invention. As shown in FIG. 7, closure element 40 comprises a plurality of units generally designated units A, B, C, and D. Each unit has a general omega shape, and comprises a bottom portion 41 which may have a generally straight line or slightly arcuate configuration. Extending from bottom portion 41 in a generally perpendicular direction therefrom is a profile portion comprising a first arm portion 42 and a second arm portion 43. As shown in FIG. 7, first arm portion 42 and second arm portion 43 are spaced apart from each other. First arm portion 42 of closure element of has a base portion 44 which initially curves generally outwardly, a middle portion 45 and a top portion 46 which curves generally outwardly before terminating in an outwardly, laterally extending, curvilinear hook portion 47.

Second arm portion 43 of closure element 40 has a base portion 48 which initially curves generally outwardly, a middle portion 49 which curves generally inwardly, and a top portion 50 which curves generally outwardly before terminating in an outwardly, laterally extending, curvilinear hook portion 51. Each of units A, B, C and D is attached to a common base 52 for attachment of closure element 40 to the sidewall of a bag or container, or to a plastic sheet. Said base 52 is formed of relatively stiff resin material or has a thickness such that it is relatively stiff and permits of only limited flexing of the portions of base 52 which join individual units A, B, C and D to each other. An optional way in which to achieve the requisite stiffness is to make the base 52 with a thickness corresponding to that of the bottom portion 41 of each unit as indicated by the dotted lines between the units shown in FIGS. 7 and 8. For the sake of brevity, the other units B, C and D depicted in FIG. 7 comprising second closure element 40 have not been number or discussed in detail, but obviously have the same structure as described unit A.

Also shown in FIG. 7 is closure element 60. Closure element 60 has a general arrowhead shape, and comprises a bottom portion 61 which may have a generally straight line or slightly arcuate configuration. Extending from bottom portion 61 in a generally perpendicular direction therefrom is a profile portion comprising a lower portion 62 which extends to arm portion 63, and then terminates as a generally rounded, enlarged, arrowhead-shaped extremity 64. Optionally, but preferably, closure element 60 is also provided with base portions 65 for attachment of closure element 60 to the sidewall of a bag or container, or to a plastic sheet.

As shown in FIG. 7, closure element 60 may occlude with closure element units A and B of second closure element 40 by insertion between the juxtaposed arm portions of neighboring units A and B of second closure element 40 until arrowhead-shaped extremity 64 of closure element 60 is interlocked by hook portion 47 of closure element unit A and hook portion 51 of closure element unit B of second closure element 40. Such an interlocked condition as shown in FIG. 7 may be described as an "outside straddle" occlusion because first closure element 60 is positioned between the arm portions of a different pair of units i.e., units A and B, of second closure element 40.

Figure 8:
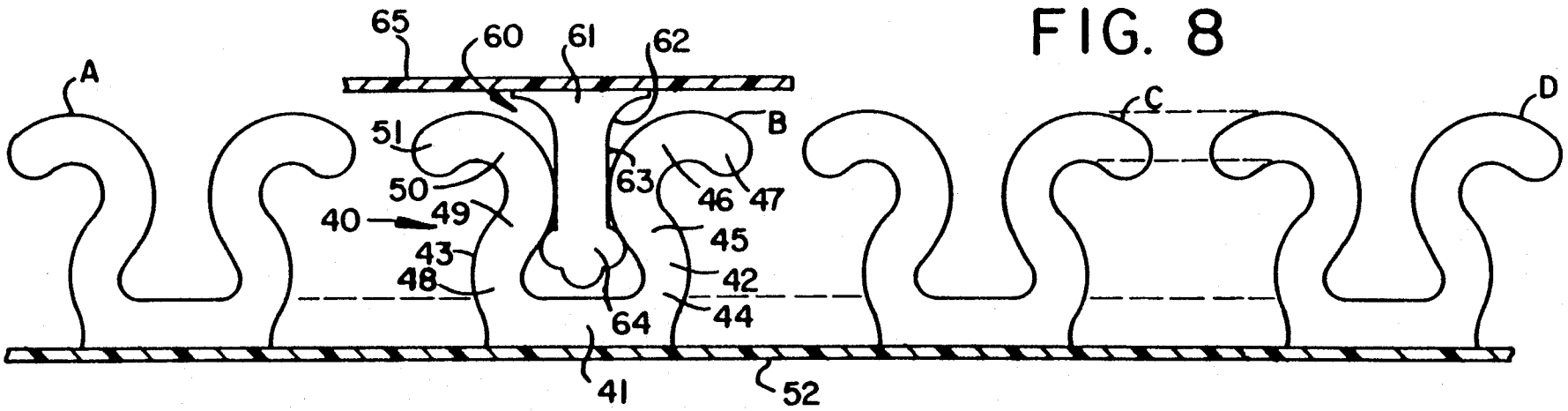
FIG. 8 is a cross-sectional view of the closure fastening device shown in FIG. 7 in a different occluded position.

FIG. 8 depicts the same closure elements as in FIG. 7, but in a different occlusion position. The occlusion position of the closure elements shown in FIG. 8 may be described as an "inside straddle" occlusion because first closure element 60 is positioned between a first arm portion 42 and a second arm portion 43 of the same closure element unit, i.e., closure element unit B of second closure element 40. From FIG. 7 and FIG. 8, it is quite apparent that the first closure element and the second closure element of this embodiment may be occluded at numerous locations with each other.

FIG. 8 also illustrates an alternative means of achieving the required degree of stiffness in closure element 40. In this alternative the juxtaposed hook portions of adjoining units A, B, C and D are joined together as shown in dotted lines joining the juxtaposed hook portions of units C and D.

Figure 9:
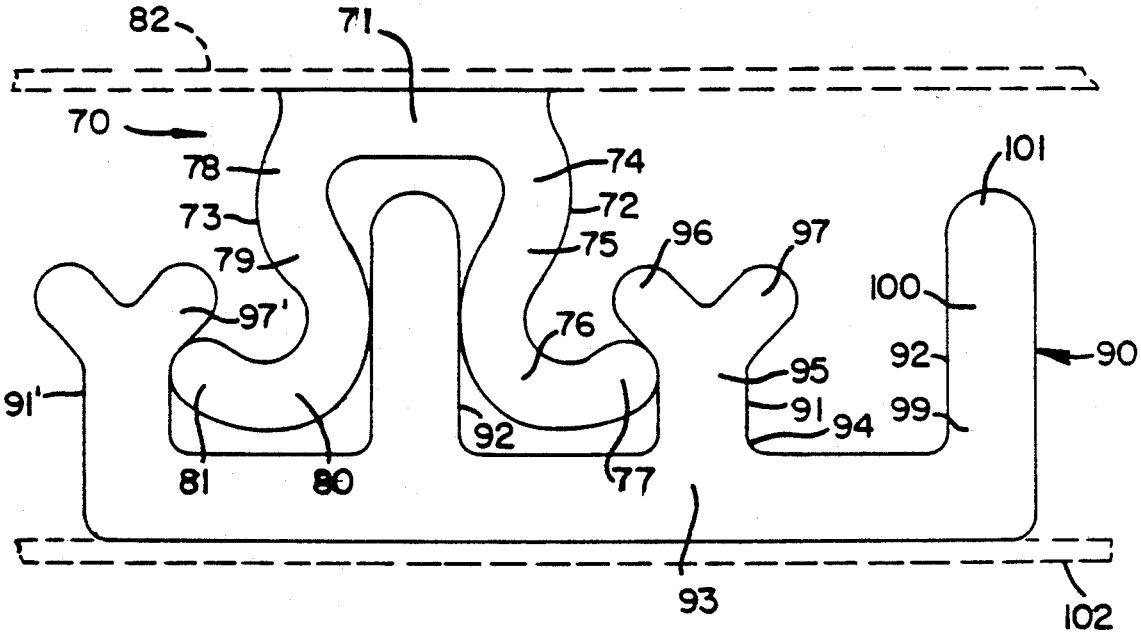
FIG. 9 is a cross-sectional view of yet another embodiment of the closure fastening device of this invention.

FIG. 9 is a cross-sectional view of another embodiment of the closure fastening device of this invention. As shown in FIG. 9, closure element 70 has a general omega shape, and comprises a bottom portion 71 which may have a generally straight line or slightly arcuate configuration. Extending from apex portion 71 in a generally perpendicular direction therefrom is a profile portion comprising a first arm portion 72 and a second arm portion 73. As shown in FIG. 9, first arm portion 72 and second arm portion 73 are spaced apart from each other. First arm portion 72 of closure element 70 has a lower portion 74 which initially curves generally outwardly, a middle portion 75 which curves generally inwardly, and a top portion 76 which curves generally outwardly before terminating in a outwardly, laterally extending, curvilinear hook portion 77.

Second arm portion 73 of closure element 70 has a lower portion 78 which initially curves generally outwardly, a meddle portion 79 which curves generally inwardly, and a top portion 80 which curves generally outwardly before terminating in an outwardly, laterally extending, curvilinear hook portion 81. Optionally, but preferably, closure element 70 is also provided with flange portions 82 shown in dotted lines for attachment of closure element 70 to the sidewall of a bag or container, or to a plastic sheet.

As also shown in FIG., 9, closure element 90 comprises a plurality of closure element units having alternately, the same configurations and structures. Closure element 90 generally comprises a plurality of Y-shape locking posts 91 and a plurality of occlusion guides 92. Locking posts 91 comprise a bottom portion 93 which may have a generally straight line or slightly arcuate configuration. Extending from bottom portion 93 in a generally perpendicular direction therefrom is a profile comprising lower portion 94 from which extends the stem portion 95. Stem portion 95 terminates into two divergent, smaller, generally rounded extremities, i.e., extremity 96 and extremity 97. Occlusion guides 92 comprise a bottom portion 93 which may have a generally straight line or slightly arcuate configuration. Extending from bottom portion 93 in a generally perpendicular direction therefrom in a profile portion comprising lower portion 99 which extends to arm portion 100. Arm portion 100 terminates in a generally rounded extremity 101. Occlusion guides 92 have a length which is larger than locking posts 91 to engage the arm portions (72 and 73) of closure element 70 before closure element 70 contacts locking posts 91 thus centering closure element 70 for proper occlusion with locking posts 91 as shown in FIG. 9. When the fastening device is occluded, hook portion 81 of first closure element 70 is in contact with extremity 97' of locking post 91', middle portion 79 and middle portion 75 of closure element 70 are in contact with occlusion guide 92, and hook portion 77 of first closure element 70 is in contact with extremity 96 of locking post 91. From FIG. 9, it may be been that closure element 70 and closure element 90 may be occluded with each other at a variety of positions. Optionally, but preferably, closure element 90 is also provided with flange portion 102 when shown in dotted lines for attachment of closure element 90 to the sidewall of a bag or container, or to a plastic sheet.

Figure 10:
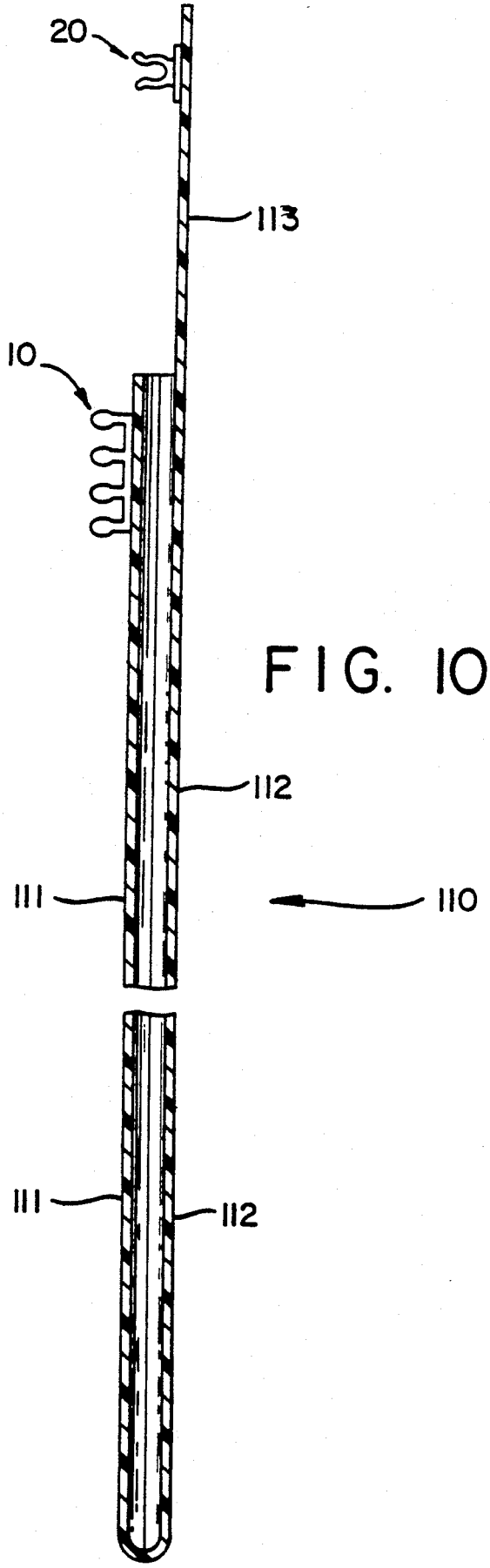
FIG. 10 is a side view of a typical variable-depth pouch, container, or storage bag, adapted with a closure fastening device of this invention.
Figure 11:
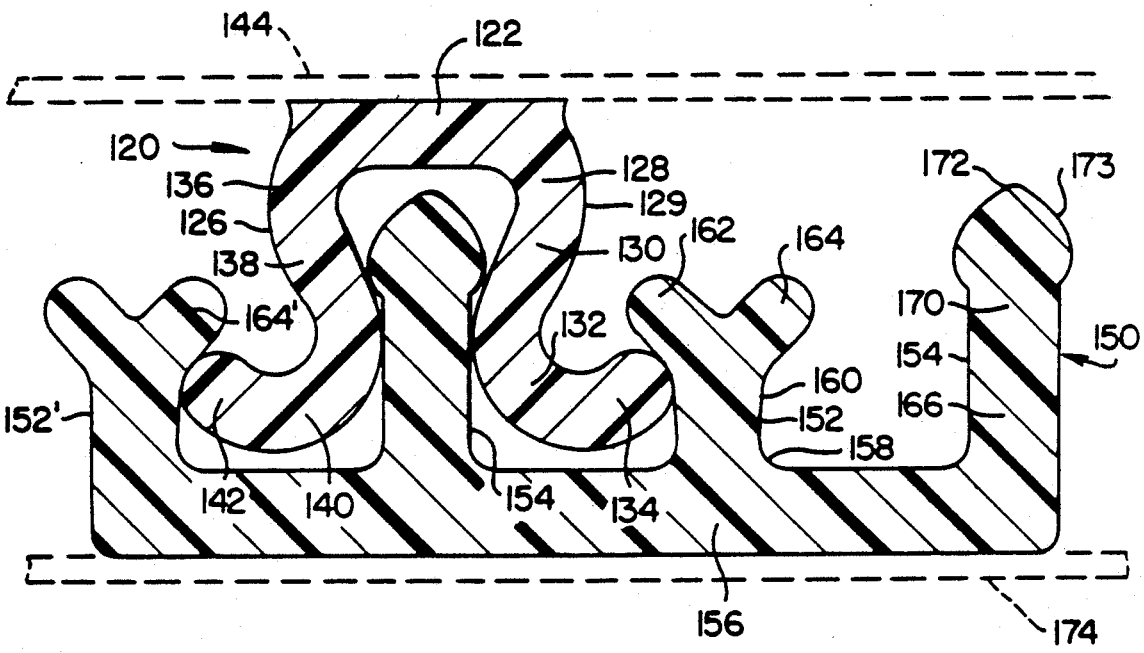

FIG. 10 is a side view of a typical variable-depth pouch, container, or storage bag, adapted with a closure fastening device of this invention. For the purposes of illustration, the closure fastening device may comprise the embodiment depicted in FIG. 1, FIG. 3, and FIG. 5. As shown in FIG. 10, the pouch, container, or storage bag 110 may have a front sidewall 111, a back sidewall 112, and a top closing flap portion 113. Front sidewall 111 may have attached thereto a second closure element 10 as depicted in FIG. 1. Top flap portion 113 may have attached thereto a first closure element 20 as depicted in FIG. 3. It can be seen that first closure element 20 may be interlocked with second closure element 10 at a number of positions on second closure element 10, i.e., with closure element units A, B, C, are D, and so on, as earlier discussed herein.

Likewise, front sidewall 111 may have attached thereto a plurality of second closure elements 10 spaced from each other to provide even more various occlusion positions with first closure element 20 and achieve different container volumes. Obviously, the container may likewise employ the closure fastening devices depicted in FIG. 7 and FIG. 9 of the instant disclosure.

The closure fastening device of the instant invention may be made from a thermoplastic material selected from the group consisting of polyolefins such as polyethylene, polyproylene, and polybutylene; polyamides such an nylon; or other thermoplastic materials, including combinations thereof. The closure fastening device is preferably made from a thermoplastic resin composition comprising low density polyethylene, or a mixture of low density polyethylene resin and high density polyethylene.

When the closure fastening device of this invention is connected to a container, it is preferred that the closure device be manufactured with flanges on each of the first and second closure elements as illustrated in FIG. 1 and FIG. 3 (base element 16 and 32) so that the flanges can be used to connect the closure elements to the container or to a film to be formed into a container. The flanges of the closure device may be made from a thermoplastic material selected from the group consisting of a polyethylene, polypropylene, nylon, and mixtures thereof. In preferred practice, the flanges and the closure elements are coextruded, however, the flanges and the closure element may be extruded separately and then attached to each other by conventional means.

The closure fastening device of this invention can be manufactured by known methods such as by extrusion, by the use of molds, or other known methods of producing such devices. The closure fastening device can be manufactured as a strip for later attachment to a film or it can be manufactured integral with the film. In addition, the closure device can be manufactured with or without flanges on one or both of the closure elements, depending upon intended use or expected additional manufacturing operations.

The closure element can be connected with a container or to a film to be formed into a container by the use of many known methods. For example, a thermoelectric device can be applied to a film opposite a closure element to cause a transfer of heat through the film to produce melting at the interface of the film and the closure element. After cooling, the interface region joins the film and the closure element.

The thermoelectric device can be heated by rotary discs, or resistance heated wires, or traveling heater bands, or the like.

The connection between the film and the closure element can also be established by the use of hot melt adhesives, or heated jets of air to the interface, or ultrasonic heating, or other known methods.

Generally, the present closure fastening device can be made from a heat sealable material and then attached to a heat sealable film so that a container can be formed economically by heat sealing surfaces to form the container. In addition to the embodiments shown herein, the closure elements can be positioned on opposite sides of a film. Such an embodiment would be suited for enwrapping an object or a collection of objects such as wires. Generally, the closure elements on a film should be parallel to each other but this would depend on the intended use. Still further, one or both of the closure elements may be colored to provide visual indexing of the closure fastening device during occlusion and deocclusion.

Although certain embodiment of the present invention have been described and set forth in detail, it should be further understood that other embodiments of the invention are contemplated by way of changes, modifications and variations to the description without departing from the scope and spirit of the invention as set forth in the appended claims. Such changes, modifications and variations are within the scope of this invention.

What is claimed is:

1. A closure fastening device comprising a first closure element and a second closure element; said first closure element comprising a profile having a generally straight bottom portion attached to a base and having a rod-shaped portion extending in a generally perpendicular direction from said bottom portion and having a generally rounded extremity with a portion of enlarged width located anteriorly of said extremity; said second closure element comprising a plurality of generally omega-shaped profile portions each of which comprises a generally straight bottom portion attached to a common base and having two spaced apart arm portions extending outwardly from opposite ends of said bottom portion, said arm portions being curved inwardly towards each other in the section closest to said bottom portion and thereafter curving outwardly and terminating in outwardly facing curvilinear hook portions, said first and second closure elements forming an interlocked closure fastening device when they are occluded together wherein the minimum distance between the interiorly curved portions of the two arms of each of said omega-shaped profile portions is substantially equal to the minimum distance between the juxtaposed curvilinear hook portions of adjoining omega-shaped profile portion.

2. A closure fastening device according to claim 1 wherein the rod-shaped portion of the profile of said first closure element is received between the interiorly curved portions of the two arms of one of said omega-shaped profile portions of said second closure element in the occluded position of said device.

3. A closure fastening device comprising a first closure element and a second closure element; said first closure element comprising a profile having a generally straight bottom portion attached to a base and having a rod-shaped portion extending in a generally perpendicular direction from said bottom portion and having a generally rounded extremity with a portion of enlarged width located anteriorly of said extremity; said second closure element comprising a plurality of generally omega-shaped profile portions each of which comprises a generally straight bottom portion attached to a common base and having two spaced apart arm portions extending outwardly from opposite ends of said bottom portion, said arm portions being curved inwardly towards each other in the sections closest to said bottom portion and thereafter curving outwardly and terminating in outwardly facing curvilinear hook portions, said first and second closure element forming an interlocked closure fastening device when they are occluded together, wherein the rod-shaped portion of the profile of said first closure element is received between the juxtaposed curvilinear hook portions of adjoining omega-shaped profile portions of said second closure element.

4. A container comprising two sidewalls and a closure fastening device, said closure fastening device comprising a first closure element and a second closure element; said first closure element comprising a profile having a generally straight bottom portion attached to a base and having a rod-shaped portion extending in a generally perpendicular direction from said bottom portion and having a generally rounded extremity with a portion of enlarge width located anteriorly of said extremity; said second closure element comprising a plurality of generally omega-shaped profile portions each of which comprises a generally straight bottom portion attached to a common base and having two spaced apart arm portions extending outwardly from opposite ends of said bottom portion, said arm portions being curved inwardly towards each other in the section closest to said bottom portion and thereafter curving outwardly and terminating in outwardly facing curvilinear hook portions said first and second closure elements forming an interlocked closure fastening device when they are occluded together, wherein the minimum distance between the interiorly curved portions of the two arms of each of said omega-shaped profile portions of said second closure element is substantially equal to the minimum distance between the juxtaposed curvilinear hook portions of adjoining omega-shaped profile portions.

5. A container comprising two sidewalls and a closure fastening device, said closure fastening device comprising a first closure element and a second closure element; said first closure element comprising a profile having a generally straight bottom portion attached to a base and having a rod-shaped portion extending in a generally perpendicular direction from said bottom portion and having a generally rounded extremity with a portion of enlarged width located anteriorly of said extremity; said second closure element comprising a plurality of generally omega-shaped profile portions each of which comprises a generally straight bottom portion attached to a common base and having two spaced apart arm portions extending outwardly from opposite ends of said bottom portion, said arm portions being curved inwardly towards each other in the section closest to said bottom portion and thereafter curving outwardly and terminating in outwardly facing curvilinear hook portions, said first and second closure elements forming an interlocked closure fastening device when they are occluded together, wherein the rod-shaped portion of the profile of said closure element is received between the juxtaposed curvilinear hook portions of adjoining omega-shaped profile portions of said second closure element.

* * * * *